US005730080A

United States Patent [19]

Cripe

[11] Patent Number: 5,730,080

[45] Date of Patent: Mar. 24, 1998

[54] ONE PERSON HUNTING BLIND

[76] Inventor: James A. Cripe, 102 E. 1st Ave., Post Falls, Id. 83854

[21] Appl. No.: 705,138

[22] Filed: Aug. 28, 1996

[51] Int. Cl.[6] ..... B63B 35/00

[52] U.S. Cl. ..... 114/344; 114/351

[58] Field of Search ..... 114/343, 347, 114/351, 344

[56] References Cited

U.S. PATENT DOCUMENTS

| | | | |
|---|---|---|---|
| 783,765 | 2/1905 | Thorne et al. | 114/351 |
| 3,612,555 | 10/1971 | Baker | 114/344 |
| 3,638,257 | 2/1972 | Ernst | 114/351 |
| 4,825,799 | 5/1989 | Bergeron et al. | 114/351 |
| 5,348,327 | 9/1994 | Gieske | 114/344 |

OTHER PUBLICATIONS

Riverside Products, Inc. brochure, "The Duck Coffin," from an unknown publication showing units on sale prior to Aug., 1995.

Mummy Blind Inc. advertisement, "Mummy Blinds," from an unknown publication showing units on sale prior to Aug., 1995.

*Primary Examiner*—Stephen Avila

*Attorney, Agent, or Firm*—Wells, St. John, Roberts, Gregory & Matkin P.S.

[57] ABSTRACT

A one person hunting blind is described in which an elongated rigid substantially water tight shell includes a bottom wall, longitudinal side walls, bow and stern end walls joining the side walls, and a top deck wall. The walls define an open occupant receiving compartment. The top deck wall includes an opening extending from the stern end toward the bow end, openly communicating with the occupant receiving compartment. The walls are shaped to receive a single occupant in a supine position with the occupant's legs and feet being covered by the top deck wall. In a preferred form, a wheel mounting member is provided on the shell between the bow and stern end walls and at least one wheel is removably mounted to the wheel mounting member and engageable with a ground surface to facilitate moving the shell over the ground surface. Floats are provided in a preferred form of the blind.

21 Claims, 8 Drawing Sheets

ONE PERSON HUNTING BLIND

TECHNICAL FIELD

The present invention relates is to hunting blinds and more particularly to a portable, single person hunting blind that will support an occupant in a supine or sitting position.

BACKGROUND OF THE INVENTION

Hunting blinds have been made in many different ways in the past, with the most popular blind being a somewhat elaborate affair constructed of a wood or metal frame covered at least in part by surrounding vegetation. These structures are time consuming to build, and are typically not portable.

Boats have also been converted to hunting blinds by the addition of camouflage materials. However ordinary fishing boats used in this manner are cannot be easily transported to a hunting site that is not close to a loading ramp with trailer access. Lighter weight "scull" boats have also been used, but are found too often to be unstable in the water, or are unwieldy in transport to and from the water along with the remainder of the gear typically needed for waterfowl hunting.

An answer to the above problem has been partially realized by several manufacturers of portable, one person blinds. One company, Riverside Products, Inc. produce a one person field blind under the trademark The "Duck Coffin". This blind is manufactured from glass impregnated resin materials to be light in weight, and is shaped somewhat similar to a coffin, to support a single occupant in a supine or sitting position. However the "Duck Coffin" is intended only for dry land use and is not intended to function as a boat. Additionally, the blind must be carried or dragged to and from the hunting site.

Another one person blind is the "Mummy" blind produced by Mummy Blind Inc. of Upperco, Md. This blind is suited primarily as a portable dry land single occupant blind. Though the blind will float, it includes a low profile, and rounded bottom surface that are not advantageous in deep water. Further, this blind also must typically be dragged across the ground to the hunting site, unless more than one person is available to help carry the 40 lb., 7.5 foot structure to the hunting site.

Other boats useful as blinds have been developed, as have other dry land blinds. However, to the Applicant's knowledge, none provide the combined benefits of the present blind as will be understood from the following drawings, specification, and appended claims.

BRIEF DESCRIPTION OF THE DRAWINGS

Preferred embodiments of the invention are described below with reference to the following accompanying drawings.

FIG. 6 is a longitudinal sectional view taken substantially along line 6—6 in FIG. 4;

FIG. 7 is a side elevation view of a second preferred form of the present blind, intended primarily as a dry land single person blind;

FIG. 9 is a bottom plan view of the first preferred form; and

DETAILED DESCRIPTION OF THE PREFERRED EMBODIMENTS

This disclosure of the invention is submitted in furtherance of the constitutional purposes of the U.S. Patent Laws "to promote the progress of science and useful arts" (Article 1, Section 8).

Figure 1:
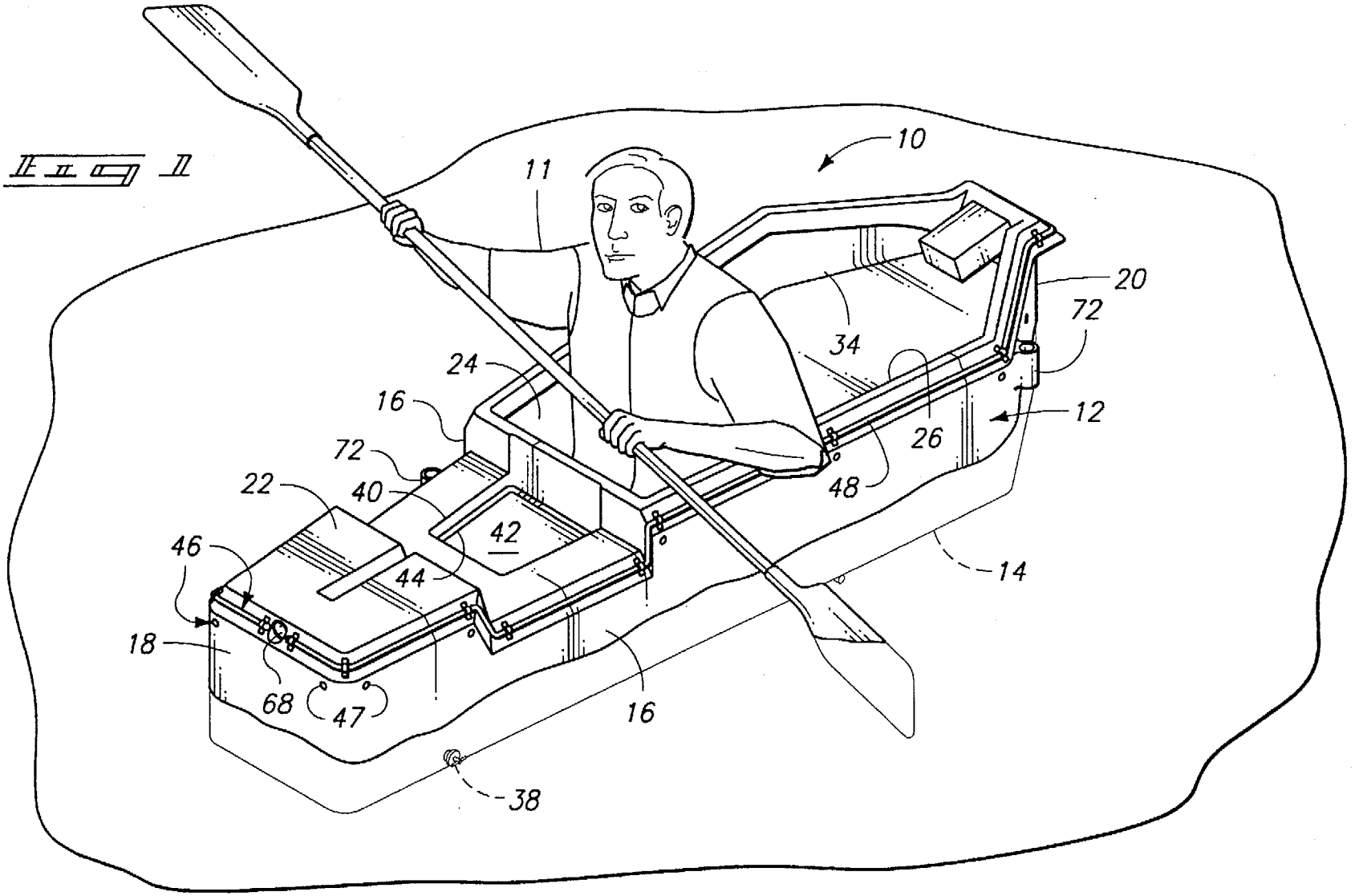
FIG. 1 is a diagrammatic perspective view of a first preferred form of the present invention in use.
Figure 2:
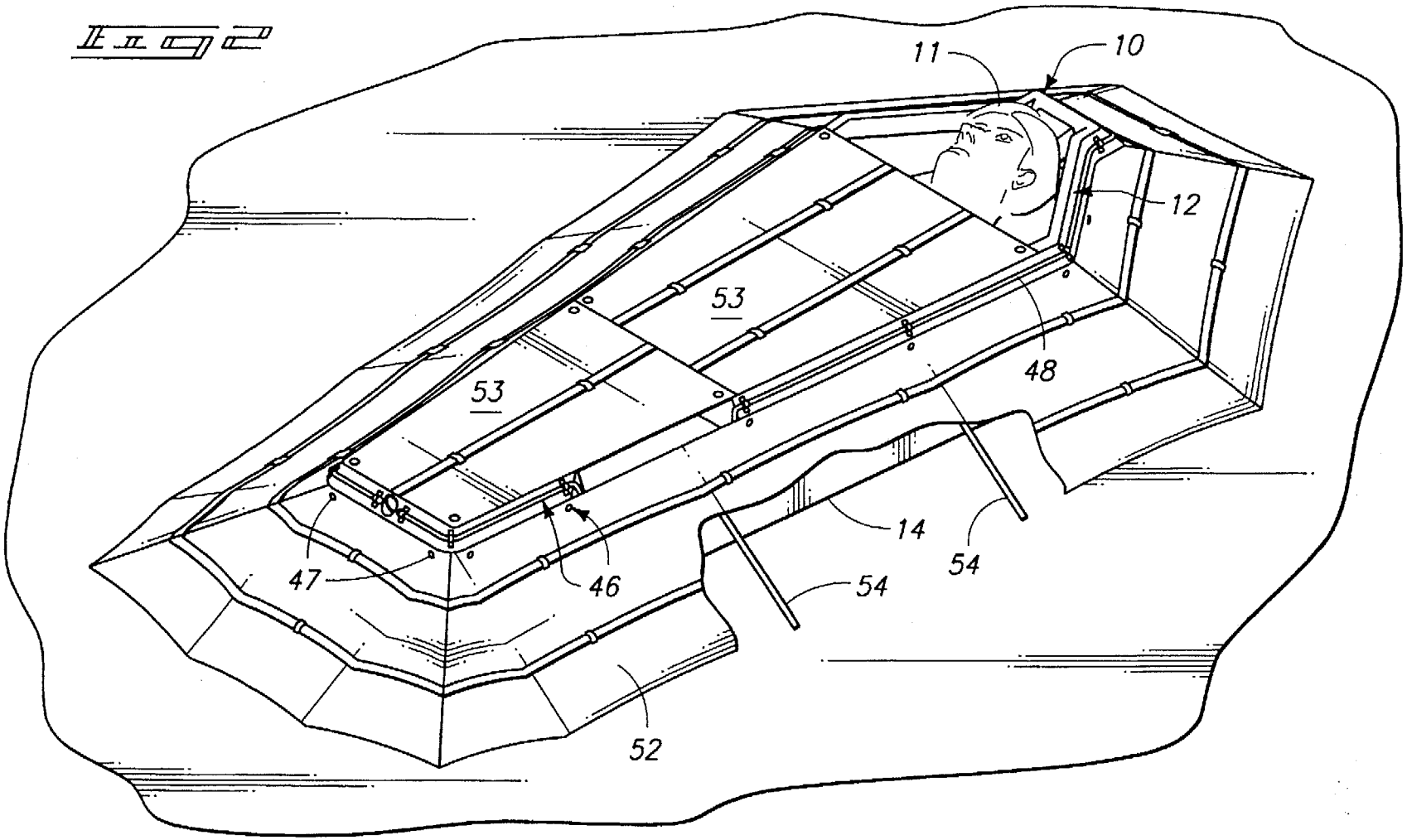
FIG. 2 is a diagrammatic perspective view showing the present blind including a camouflage shroud.
Figure 3:
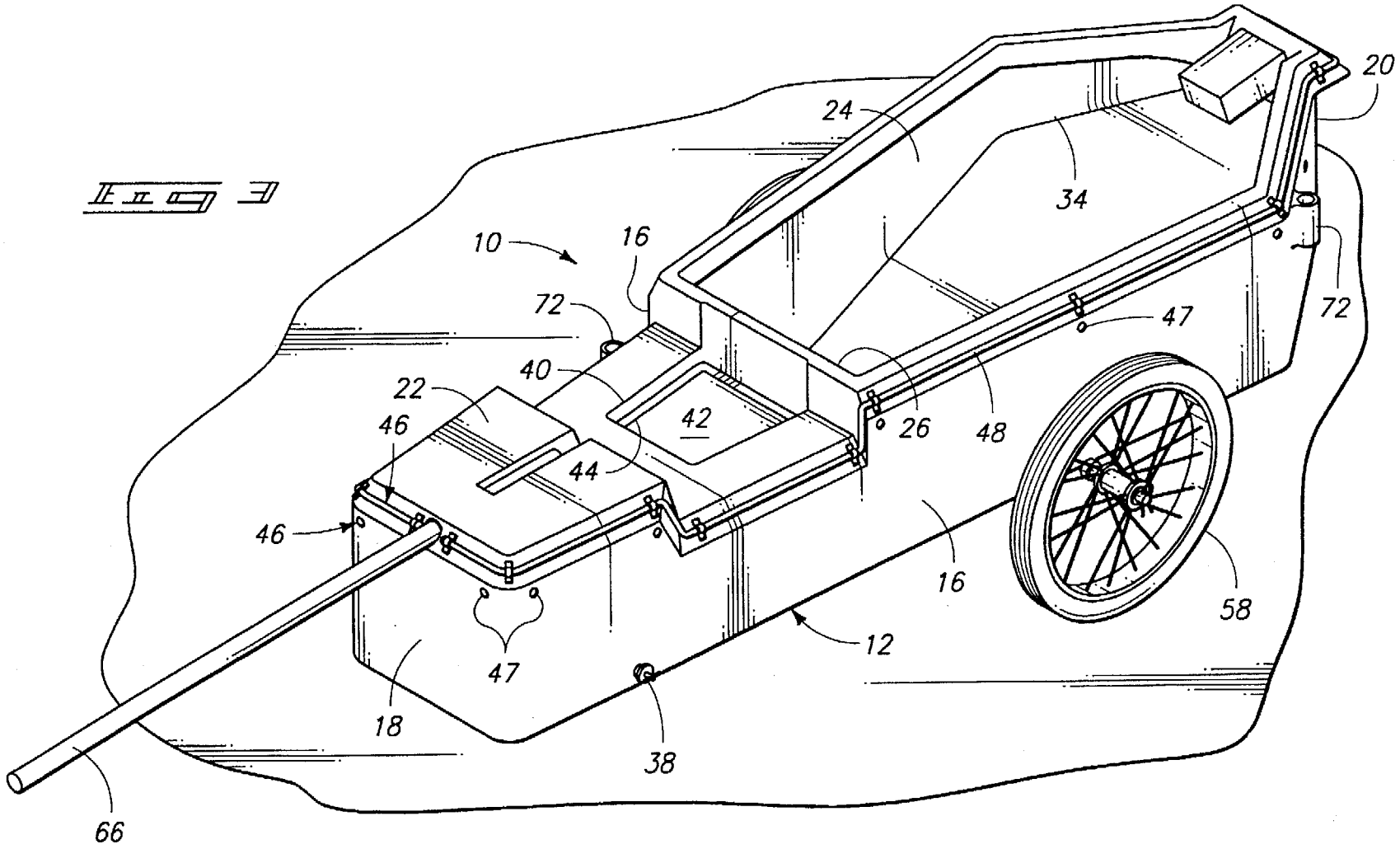
FIG. 3 is a perspective view of the first preferred form of the present blind with wheels mounted thereon and further showing a handle attached to the shell to facilitate transport.
Figure 4:
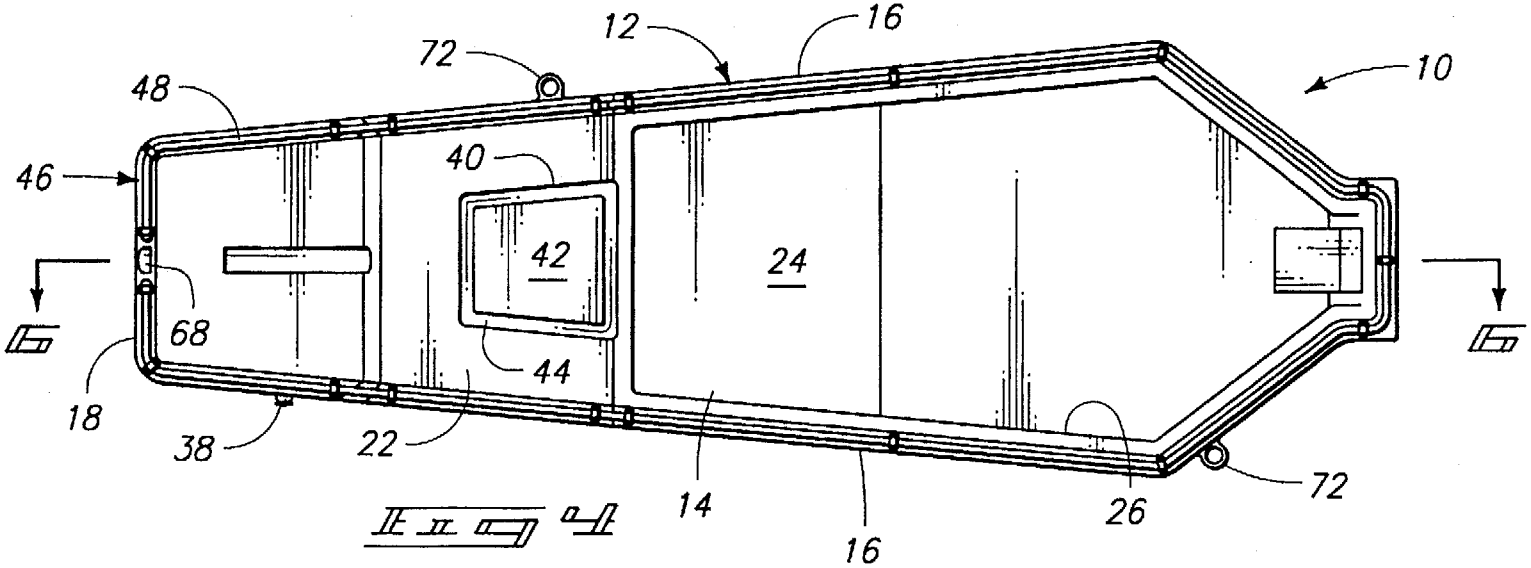
FIG. 4 is top plan view of the preferred blind.
Figure 5:
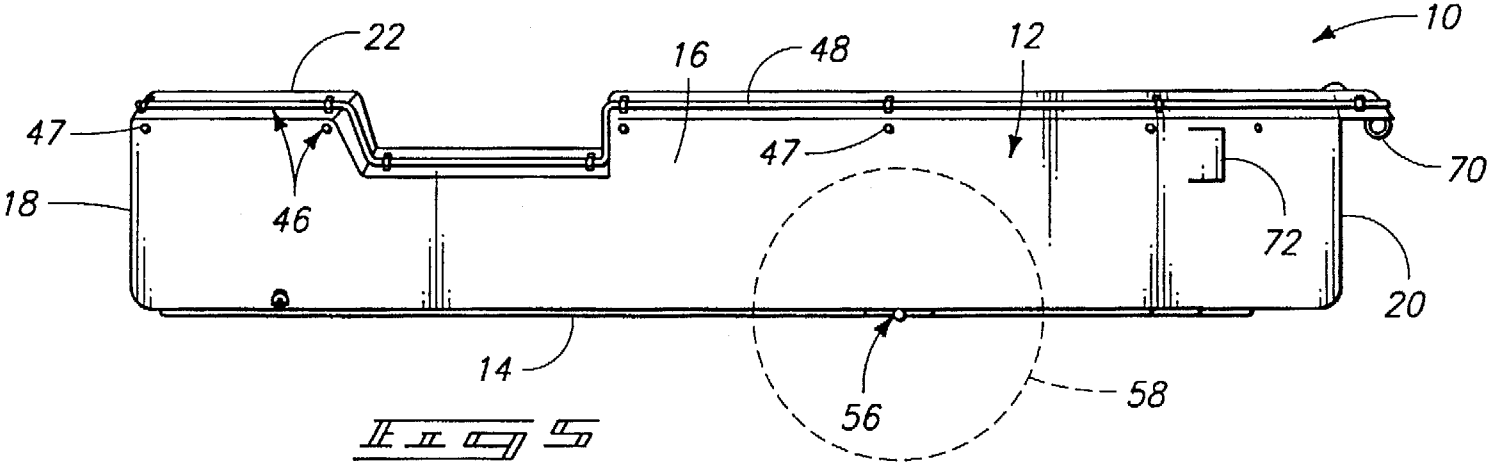
FIG. 5 is a side elevation view of the first preferred form, with a wheel shown in dashed lines.
Figure 5:
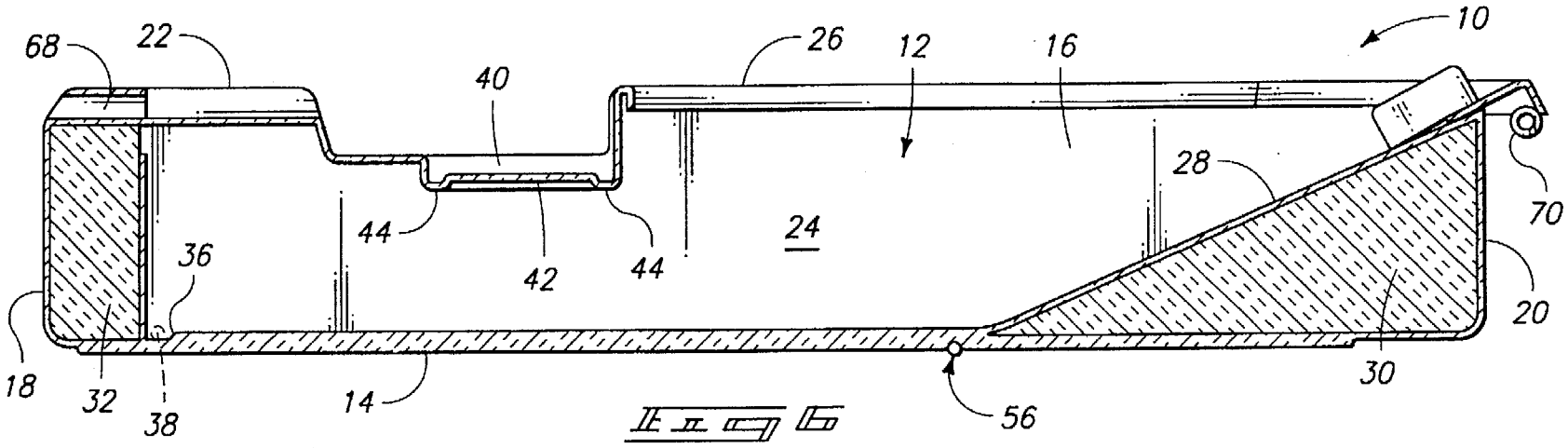
Figure 11:
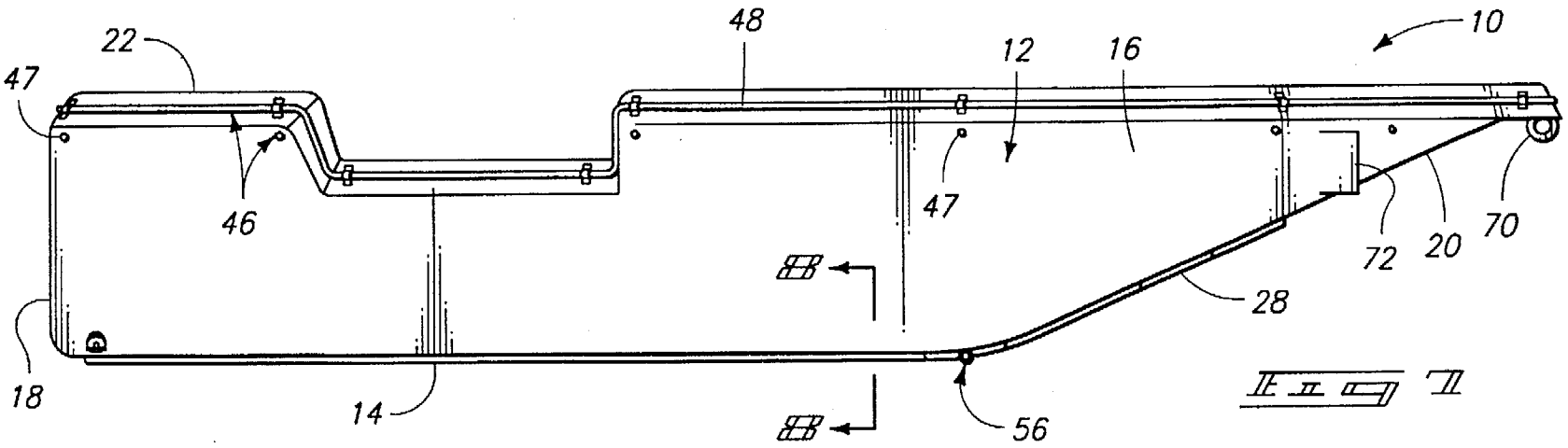
Figure 8:
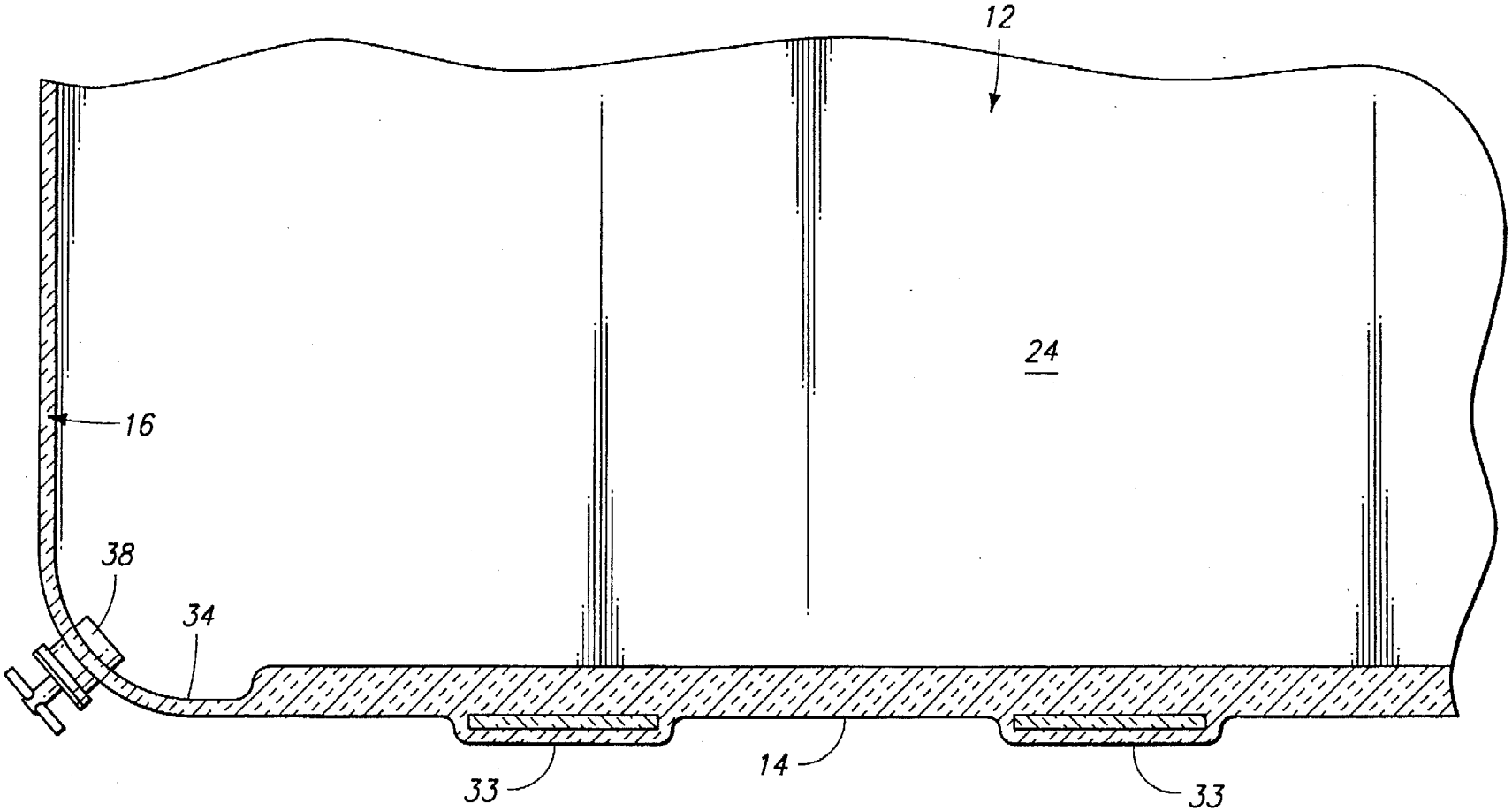
FIG. 8 is an enlarged sectional view taken substantially along line 8—8 in FIG. 7.
Figure 11:
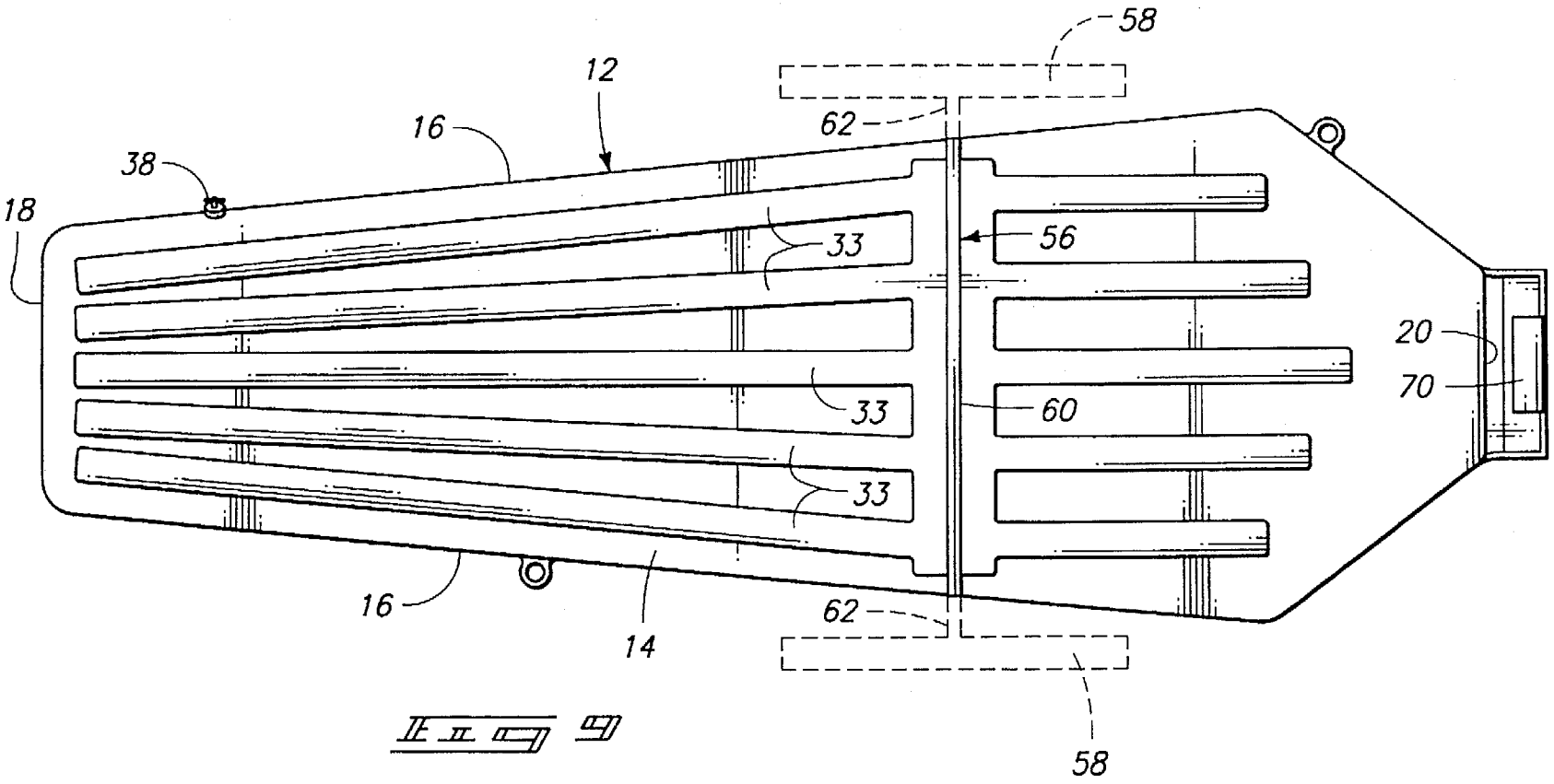

The present invention is disclosed herein, including two basic examples of preferred embodiments thereof. In FIGS. 1 and 3–6, a first preferred form is shown, which will function equally well as a dry land blind, or as a boat type blind capable of floating in deep water. In FIGS. 7 and 8, an alternate form is shown, primarily for use in dry land hunting situations. Either of the forms exemplified may be used on dry land (which should be understood to include muddy or marshy areas in addition to literally dry land surfaces) with a camouflage shroud substantially as shown in FIG. 2.

Since both preferred examples include many similar features, the discussion below (where reference numerals refer to similarly numbered elements in the drawings), may be taken as description of both forms except where differences are specifically pointed out. Given the above understanding, reference will now be made in more detail to the drawings.

Both preferred forms of the present blind are generally designated in the drawings by the reference numeral 10. The blind 10 is intended to support an occupant 11 in either a supine position as shown in FIG. 2, or a sitting position as shown in FIG. 1. On dry land, of course, the occupant may also elect to stand erect in the blind. However as a safety matter, standing is not recommended and should be avoided when the blind is afloat in deep water.

Preferred forms of the present blind 10 include an elongated substantially rigid shell 12. The shell 12 is water-tight and preferably formed of a corrosion resistant material such as glas.s fiber impregnated resin, commonly known as "fiberglass". The preferred shell includes a bottom wall 14, that is bordered by substantially upright longitudinal side walls 16, a bow end wall 18 and a stern end wall 20 joining the side walls 16. A top deck wall 22 is spaced above the bottom wall 14 and joins the side walls 16 and end walls 18, 20.

The walls 14, 16, 18, 20, and 22 define an open occupant receiving compartment 24, and are shaped to receive a single occupant in a supine position with the occupant's legs and feet being covered by the top deck wall 22. To this end, the top deck wall 22 includes an opening 26 extending from the stern end 20 toward the bow end wall 18, openly communicating with the occupant receiving compartment.

It is of interest to note that at least part of the bottom wall 14 is substantially flat and horizontal. This is done to provide stability both on land and on water. In the preferred dry land version (FIG. 7), a part 28 of the bottom wall 14 is inclined upwardly, forming an inclined stern end wall 20 and providing a comfortable back rest for the occupant 11 when lying in the supine position. This same part 28 is also provided in the preferred version (FIGS. 1, 3, 5, and 6) for water use, except that the bottom wall 14 in this form also extends fully to the upright stern end wall 20 of the shell. This arrangement creates a float in the form of a triangular shaped sealed chamber 30 (FIG. 6) with the stern part of bottom wall 14, the part 28, and the stern end wall 20 forming sides thereof.

In a preferred form, the floatation chamber 30 is sealed and filled with a closed cell flotation foam material commonly used for flotation in many current forms of water craft. An additional float (preferably more foam material) is provided at 32 (FIG. 6) adjacent the bow end wall 18 in the first preferred form of the present blind. It is preferred that at least approximately twice the flotation capacity is provided adjacent the stern end (using the triangular chamber 30) as that provided by the float 32.

In a working prototype approximately 0.78 cubic feet of flotation material is provided in flotation compartment 30 adjacent the bow end wall 18, and 2.3 cubic feet of flotation is provided adjacent the stern end wall 20. With both areas filled with foam flotation, the blind becomes substantially unsinkable, and if swamped and upright, will maintain a 258 lb. supine occupant's head above the water level.

The above example assumes a 50 lb. shell weight, an overall length between stern end wall 20 and bow end wall 18 of 81 inches, a stern end wall width of 15 inches, a average beam of 21 inches, and a side wall height (to the gunwales at the perimeter of the opening 26) of 14.5 inches.

A series of longitudinal flutes 33 are formed on the outside bottom surface of bottom wall 14. The sectional view in FIG. 8 and the bottom plan view of FIG. 9 show how the preferred individual flutes are molded along the bottom. The flutes strengthen the bottom and provide a "keel-like" action to keep the shell tracking when being paddled in deep water as shown in FIG. 1. The flutes 33 are similar in both forms of the shell and are formed integrally with the bottom wall 14.

On the inside top surface of the bottom wall 14, shallow drainage troughs 34 (FIGS. 3, 8) are formed that lead forwardly from locations adjacent stern end wall 20. The troughs extend longitudinally along the intersection of the side walls 16 and part 28 of bottom wall 14 to the horizontal part, then on forwardly toward the bow end wall 18. The troughs are designed to catch and channel water (such as rain water) along side the occupant, thereby keeping the occupant dry. A sump 36 (FIG. 6) is formed across the bottom wall, joining the troughs 34 to collect water and hold it for drainage.

A drain plug 38 is provided in one of the side walls, adjacent the bottom wall and opening into the sump 36 to permit selective drainage of the compartment. When the shell is used on dry land as shown in FIG. 2, the plug can be removed so any rainwater collected in the shell will run along the troughs, to the sump, and out through the open drain hole. When the shell is used in water, the drain plug will be closed to prevent exterior water from seeping into the compartment.

In a preferred form, an upwardly open receptacle 40 is formed in the top deck wall 22, forwardly adjacent the opening 26. Receptacle 40 is provided to receive accessories to the hunt, such as ammunition, lunch, or other loose items that should be readily accessible. An article support surface 42 at the bottom of the receptacle is advantageously surrounded by a water collection depression 44 formed in the receptacle below the article support surface 42. Water spilling into the receptacle will tend to collect in the depression below the surface 42, so items on the support surface 42 will remain dry.

It is preferred to provide camouflage mounting members 46 on the shell, near the top deck wall 22. Members 46 in one form include elastic bands 48 stretched around the perimeter of the shell, that are useful to hold, say, plant stalks against the shell. In another preferred form, members 46 include snaps 47 that releasably mount a camouflage shroud 52 (FIG. 2) that is preferably used on dry land to obstruct the straight or regular lines of the shell.

Supportive rods 54 underlie the shroud 52 and can be mounted to the shell as shown, extending angularly down to the ground surface to hold the shroud in a "tent-like" configuration from the shell sides, thereby lending a more natural "mound" appearance to the shell that will blend more completely with most surrounding terrain. To this end, camouflage flaps 53 may be provided, loosely draped over the opening 26 as shown in FIG. 2, to better cover the top deck surface and the occupant.

A distinct advantage is found in preferred forms of the present blind in which a wheel mounting member 56 and at least one and preferably a pair of removable wheels 58 are mounted on the shell 12 between the bow and stern end walls. The mounting member 56 enables the wheels 58 to be mounted to the shell for transporting the shell with minimal effort by a single person. The same mounting member 56 also facilitates removal of the wheels 58 so the shell can be firmly seated on the ground surface or floated easily in water.

Figure 10:
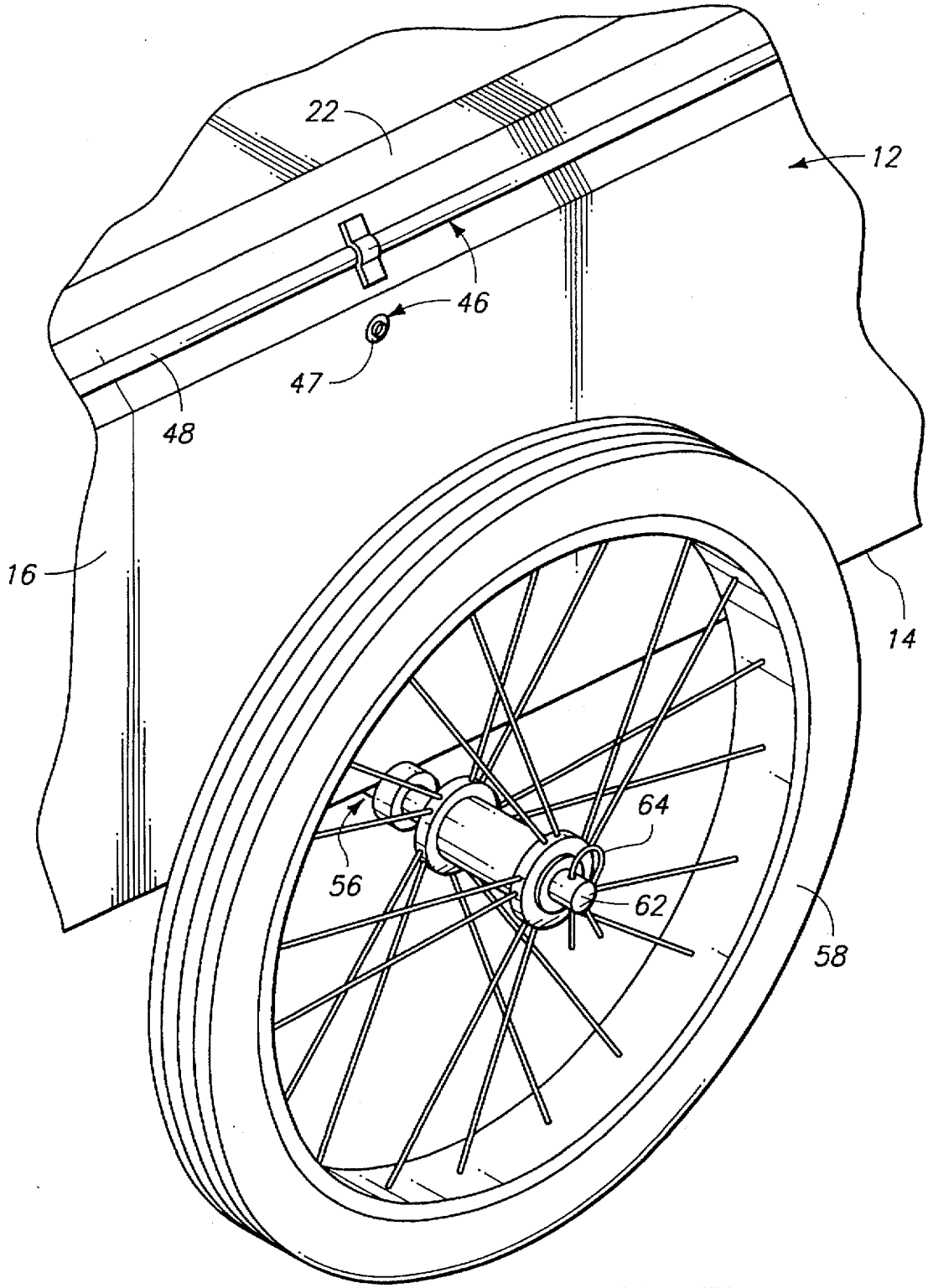
FIG. 10 is an enlarged fragmented view of a wheel and wheel mounting member.

More specifically, a preferred example of the mounting member is shown as a wheel axle receiving tube 60 mounted to the shell 12. The tube extends transversely across the shell, along the bottom wall 14 and is rigidly held in place by the material of the shell. An axle shaft 62 is slidably received in the tube and extends to either side of the shell. The wheels 58 are rotatably mounted on the axle shaft, one adjacent each upright side wall 16, and are held in place by removable latch devices 64 (FIG. 10) that releasably secure the wheels to the axle shaft. In the example illustrated, simple conventional cotter pins and washers suffice as the latching devices.

In order to provide maximum maneuverability for the blind, a handle 66 (FIG. 3) is releasably mounted to the shell adjacent the bow end wall 18, along the top deck wall 20. The handle 66 extends longitudinally from a longitudinal socket member 68 formed in the top deck wall adjacent the bow end wall. The socket member 68 is formed in the shell adjacent the bow end wall and is configured to releasably receive the tow handle. When placed in the socket member 68, the tow handle 66 will enable an individual to easily push or pull and steer the blind to or from a hunting site. An appropriate harness (not shown) may be connected to the shell or to the tow handle, and fitted to the individual to free his or her hands to carry any materials not placed and carried in the shell occupant compartment.

In addition to the tow handle 66, an integral tubular handle piece 70 (FIGS. 5–7) is provided in preferred forms of the shell, at the stern end. The handle piece 70 is transverse to the length of the shell and is secured to the shell at the intersection of the stern end wall 20 and the top deck wall 22. The handle piece 70 is hollow to provide an anchor point on the shell for a painter line (not shown).

Upright tubular sockets 72 are also secured to the shell, on opposite sides and toward opposite ends, to receive anchor poles (not shown) that are used to secure the shell in position. Such poles are typically used in relatively shallow water where it is desired that the shell stay firmly in a selected location. The poles can be slidably fitted through the sockets 72, then driven downwardly into the ground surface below the water. The poles then serve to hold the shell against drifting or swinging about.

Prior to operation, either preferred form of the present blind 10 is easily loaded into the bed of a truck or the cargo area of another appropriate form of vehicle (not shown). The wheels 58 are preferably removed at this point to reduce the bulk of the blind and to prevent it from rolling about during transport.

After arrival at an area adjacent the desired hunting site, the shell is simply removed from the vehicle and the wheels are attached. This is done simply by sliding the axle shaft 62 through the axle tube and mounting the wheels 58 to the exposed axle ends. The cotter pins 64 are then positioned, and the handle 66 (FIG. 3) is inserted through the handle mounting socket 68 (if desired). Any extra gear, such as paddles, decoys, lunch, ammunition and gun may be loaded into the occupant compartment 24. The blind may now be moved easily over nearly any terrain with freely rotatable wheels 58 movably carrying the load.

If it is desired to hunt on dry land, the user simply stops where desired, preferably along a section of flat ground, and removes the wheels and handle. Camouflage materials may now be added to the elastic bands 48 and, if desired the shroud may be placed about the blind, with further vegetation added to the shroud for a more complete camouflage effect. After all is readied and the decoys are deployed, the hunter may step into the occupant compartment. If full camouflage is desired, the hunter may lie down in the occupant compartment, to a supine position as shown in FIG. 2. Nearly all of the hunter's body is now concealed and may remain in position, warm and dry, until the quarry arrives. At this time, the hunter can quickly raise to a sitting position for shooting.

If inclement weather is encountered, the plug 38 may be removed, allowing any water to drain down the troughs 34 and out of the occupant area. The occupant will thus remain relatively dry and warm, even in a heavy rainstorm.

If it is desired to hunt on water, the first preferred form of the present blind (FIGS. 1, 5 and 6) is used, starting with the same initial procedures described above. The blind is wheeled to the shore where the wheels and handle can be removed. The hunter may then slide the blind into the water, step into the occupant compartment, sit down and paddle the blind across the water surface to a desired hunting location. The blind can be paddled about the area to deploy floating decoys, then to a desired anchorage area. The flat bottom of the shell and upright side walls serve to hold the blind stable when paddling. Should an accident occur where the blind becomes swamped (filled with water), the described extra flotation provided will help the occupant stay afloat and allow maneuvering of the blind back to dry ground.

Assuming a hunting site has been selected, the appropriate anchorage poles may be slid downwardly through the upright sockets 72 and staked to the pond, lake or stream bottom. Camouflage may now be positioned, or may have been earlier positioned about the shell to hide the hunter. The hunter may now lie down in a supine position, awaiting arrival of the prey.

When the hunt is over, the hunter may simply reverse the above steps, gathering the decoys, removing the camouflage, replacing the wheels and loading the passenger compartment before wheeling the blind back to a vehicle for the trip home.

In compliance with the statute, the invention has been described in language more or less specific as to structural and methodical features. It is to be understood, however, that the invention is not limited to the specific features shown and described, since the means herein disclosed comprise preferred forms of putting the invention into effect. The invention is, therefore, claimed in any of its forms or modifications within the proper scope of the appended claims appropriately interpreted in accordance with the doctrine of equivalents.

I claim:

1. A one person hunting blind, comprising:

a elongated rigid substantially water tight shell including a bottom wall, longitudinal side walls, bow and stern end walls joining the side walls, and a top deck wall;

wherein said walls define an open occupant receiving compartment;

wherein the top deck wall includes an opening extending from the stern end toward the bow end, openly communicating with the occupant receiving compartment;

wherein the bottom wall, top deck wall, and side walls are shaped to receive a single occupant in a supine position with the occupant's legs and feet being covered by the top deck wall;

a wheel mounting member integral with the shell between the bow and stern end walls; and at least one wheel removably mounted to the wheel mounting member and engageable with a ground surface to facilitate moving the shell over the ground surface.

2. A one person hunting blind as defined by claim 1, further comprising:

a tow handle socket member formed in the shell adjacent the bow end wall.

3. A one person hunting blind as defined by claim 1, further comprising:

a longitudinal tow handle socket member formed in the top deck wall adjacent the bow end wall; and a tow handle slidably received in the socket member.

4. A one person hunting blind as defined by claim 1, wherein the bottom wall includes:

drainage troughs leading from locations adjacent stern end wall longitudinally along the side walls to the bow end wall; and a sump adjacent the bow end wall formed in the top surface of the bottom wall and joining the drainage troughs.

5. A one person hunting blind as defined by claim 1, wherein the bottom wall includes:

drainage troughs leading from locations adjacent stern end wall longitudinally along the side walls to the bow end wall;

a sump adjacent the bow end wall and joining the drainage troughs; and a drain plug formed through one of the walls and opening into the sump, selectively openable to permit drainage of the sump.

6. A one person hunting blind as defined by claim 1, further comprising:

a drain plug formed through one of the walls and opening into the occupant receiving compartment, selectively openable to permit drainage of the occupant receiving compartment.

7. A one person hunting blind as defined by claim 1, further comprising:

an upwardly open receptacle formed in the top deck wall adjacent the opening and including an article support surface; and a water collection depression formed in the receptacle below the article support surface.

8. A one person hunting blind as defined by claim 1, wherein the bottom wall includes a relatively flat bottom part adjacent the bow end wall and extending therefrom to the stern end wall, and an inclined part joined to the flat bottom part and leading upwardly to the stern end wall, forming a closed flotation chamber adjacent the stern end wall.

9. A one person hunting blind as defined by claim 1, comprising:

floats adjacent the bow and stern end walls with the float at the stern end wall including at least twice the buoyancy of the float adjacent the bow end wall.

10. A one person hunting blind as defined by claim 1, further comprising:

camouflage mounting members on the shell.

11. A one person hunting blind as defined by claim 1, further comprising:

camouflage mounting members on the shell; and a flexible camouflage shroud releasably mounted to the camouflage mounting members including supportive rods mountable to the shell and outwardly extendable therefrom to enshroud the side, bow, and stern ends of the shell.

12. A one person hunting blind as defined by claim 1, further comprising:

a wheel axle mounted to the the wheel mounting member; and wherein the wheel is removably mounted to the wheel axle.

13. A one person hunting blind as defined by claim 1, wherein the wheel mounting member is comprised of:

a wheel axle receiving tube mounted integral with the shell;

wherein there are a pair of said wheels; and an axle shaft received in the wheel axle receiving tube and releasably mounting the pair of wheels, one adjacent each side wall; and a latch device releasably securing the wheels to the axle shaft.

14. A one person hunting blind, comprising:

a elongated rigid water-tight shell including a bottom wall, substantially upright longitudinal side walls, bow and stern end walls joining the side walls, and a top deck wall;

wherein said walls define an open occupant receiving compartment;

wherein the occupant receiving compartment is configured to receive a single occupant in a supine position with the occupant's legs and feet being at least partially covered by the top deck wall and with the feet adjacent the bow end wall and the head adjacent the stern end wall;

wherein the top deck wall includes an opening extending from the stern end toward the bow end, openly communicating with the occupant receiving compartment and configured to permit the occupant to selectively lie in the supine position, and to sit up in a seated position;

at least one float within the shell of sufficient buoyancy to float the shell and the single occupant in water with the occupant positioned in the occupant receiving compartment and with the occupant receiving compartment filled with water; and wherein at least a part of the bottom wall is relatively flat and horizontal and the side walls are substantially upright to stabilize the shell when afloat.

15. A one person hunting blind as defined by claim 14, wherein the bow and stern end walls are substantially vertical.

16. A one person hunting blind as defined by claim 14, wherein the float is comprised of a flotation chamber situated adjacent the stern end wall.

17. A one person hunting blind as defined by claim 14, wherein the float is comprised of a stern flotation chamber situated adjacent the stern end wall, and bow flotation material adjacent the bow end wall.

18. A one person hunting blind as defined by claim 14, wherein the bottom wall includes a relatively flat bottom part adjacent the bow end wall and extending therefrom to the stern end wall, and an inclined part joined to the flat bottom part and leading upwardly to the stern end wall, forming a closed stern flotation chamber adjacent the stern end wall; and bow flotation material adjacent the bow end wall; and wherein the stern flotation chamber includes at least twice the flotation capacity of the flotation material adjacent the bow end wall.

19. A one person hunting blind as defined by claim 14, further comprising:

a drainage trough extending longitudinally along the bottom wall and open to the occupant receiving compartment;

a sump adjacent the bow end wall formed in the top surface of the bottom wall and joining the drainage trough; and a drain plug formed through one of the walls and opening into the sump, selectively openable to permit drainage of the sump.

20. A one person hunting blind as defined by claim 14, further comprising:

an upwardly open receptacle formed in the top deck wall adjacent the opening and including an article support surface; and a water collection depression formed in the receptacle below the article support surface.

21. A one person hunting blind, comprising:

a elongated rigid shell including a bottom wall, substantially upright longitudinal side walls, bow and stern end walls joining the side walls, and a top deck wall;

wherein said walls define an open occupant receiving compartment;

wherein the occupant receiving compartment is configured to receive a single occupant in a supine position with the occupant's legs and feet being at least partially covered by the top deck wall and with the feet adjacent the bow end wall and the head adjacent the stern end wall;

a wheel mounting member integral with the rigid shell between the bow and stern end walls; and at least one wheel removably mounted to the wheel mounting member and rotatably engageable with a ground surface to facilitate transport of the shell over the ground surface;

a handle receiving socket formed integrally in the shell adjacent the bow end wall;

a handle releasably received by the handle receiving socket and spaced longitudinally from the wheel mounting member for manipulating the shell during movement over the ground surface;

wherein the top deck wall includes an opening extending from the stern end toward the bow end, openly communicating with the occupant receiving compartment and configured to permit the occupant to selectively lie in the supine position, and to sit up in a seated position;

at least one float in the shell of sufficient buoyancy to float the shell and the single occupant in water with the occupant positioned in the occupant receiving compartment and with the occupant receiving compartment filled with water; and wherein the bottom wall and side walls are configured to stabilize the shell when afloat.

* * * * *